US009145003B2

(12) United States Patent
Lu et al.

(10) Patent No.: US 9,145,003 B2
(45) Date of Patent: Sep. 29, 2015

(54) MARKING DEVICE

(71) Applicants: FU DING ELECTRONICAL TECHNOLOGY (JIASHAN) CO.,LTD., Zhejiang (CN); HON HAI PRECISION INDUSTRY CO., LTD., New Taipei (TW)

(72) Inventors: Jian-Qiang Lu, Jiashan (CN); Zhong Li, Jiashan (CN); Jian-Hua Xu, Jiashan (CN)

(73) Assignees: FU DING ELECTRONICAL TECHNOLOGY (JIASHAN) CO., LTD., Zhejiang (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/326,609

(22) Filed: Jul. 9, 2014

(65) Prior Publication Data

US 2015/0015653 A1 Jan. 15, 2015

(30) Foreign Application Priority Data

Jul. 10, 2013 (CN) ..... 2013 1 02881381

(51) Int. Cl.

| | |
|---|---|
| ***B41J 3/407*** | (2006.01) |
| *B41J 23/00* | (2006.01) |
| *B41J 29/38* | (2006.01) |

(52) U.S. Cl.

CPC ..... *B41J 3/407* (2013.01)

(58) Field of Classification Search

CPC ..... B41J 19/14; B41J 25/003; B41J 3/28

See application file for complete search history.

(56) References Cited

U.S. PATENT DOCUMENTS

| | | | | |
|---|---|---|---|---|
| 4,941,745 | A * | 7/1990 | Sugiyama | 356/401 |
| 5,011,366 | A * | 4/1991 | Miller | 414/811 |
| 6,755,518 | B2 * | 6/2004 | Codos | 347/102 |
| 6,966,427 | B2 * | 11/2005 | Kilibarda | 198/465.4 |
| 8,235,520 | B2 * | 8/2012 | Ushiyama | 347/102 |
| 2003/0063154 | A1 * | 4/2003 | Goto | 347/40 |
| 2003/0142167 | A1 * | 7/2003 | Nakamura et al. | 347/37 |
| 2003/0179252 | A1 * | 9/2003 | Nakamura | 347/2 |
| 2011/0181671 | A1 * | 7/2011 | Ishibe et al. | 347/85 |

* cited by examiner

*Primary Examiner* — Stephen Meier
*Assistant Examiner* — John P Zimmermann
(74) *Attorney, Agent, or Firm* — Novak Druce Connolly Bove + Quigg LLP

(57) ABSTRACT

A workpiece marking device operating automatically includes a support member, a transmission member, a feeding mechanism, a discharging mechanism, a driving mechanism, a positioning tool, and a marking mechanism. The transmission member conveys a workpiece, the feeding mechanism includes a driving assembly coupled to the support member and a lifting member coupled to the driving assembly. The discharging mechanism is positioned on the support member and above the transmission member. The discharging mechanism includes a driving assembly coupled to the support member and a lifting member coupled to the driving assembly of the discharging mechanism to move workpieces away after marking.

20 Claims, 3 Drawing Sheets

MARKING DEVICE

FIELD

The subject matter herein generally relates to marking devices.

BACKGROUND

In automatic machining, workpieces can be marked by a marking device. During marking, the workpieces are fed to the marking device.

BRIEF DESCRIPTION OF THE DRAWINGS

Implementations of the present technology will now be described, by way of example only, with reference to the attached figures.

DETAILED DESCRIPTION

Figure 1:
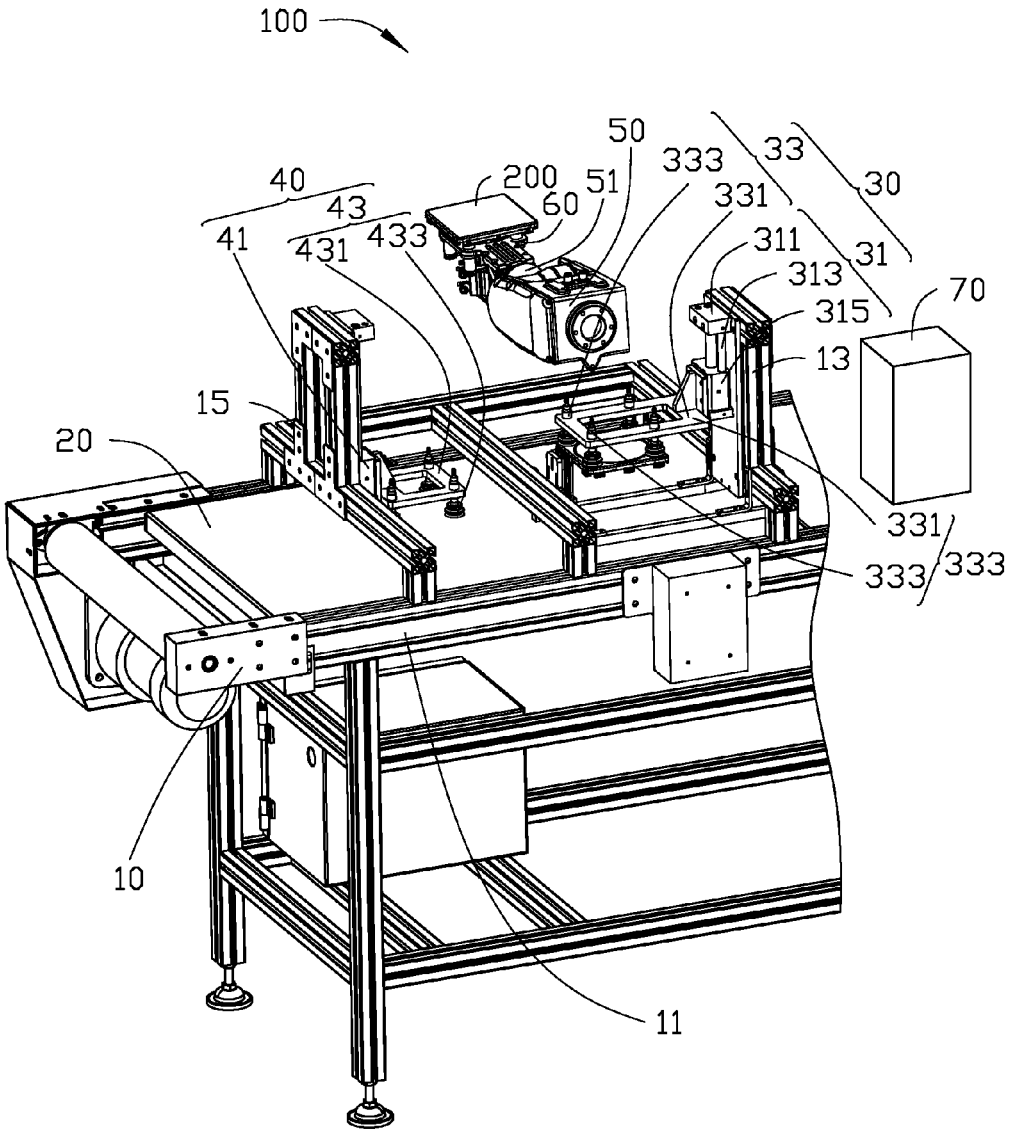
FIG. 1 is an isometric view of an embodiment of a marking device including a positioning tool, the positioning tool including an engaging member.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is in relation to a marking device including a support member, a transmission member, a feeding mechanism, a discharging mechanism, a driving mechanism, a positioning tool, and a marking mechanism. In at least one embodiment, the marking device can also be a selecting device. The transmission member can be mounted on the support member and configured to convey a workpiece. The feeding mechanism can be positioned on the support member above the transmission member. The feeding mechanism can include a driving assembly coupled to the support member and a coupling member coupled to the driving assembly. The discharging mechanism can be positioned on the support member above the transmission member. The discharging mechanism can include a driving assembly coupled to the support member and a coupling member coupled to the driving assembly of the discharging mechanism. The driving mechanism can be positioned adjacent to the transmission member. The positioning tool can be coupled to the driving mechanism. The marking mechanism can be positioned adjacent to the transmission member. The driving assembly of the feeding mechanism can be configured to drive the coupling assembly of the feeding mechanism to lift up the workpiece, the driving mechanism is configured to drive the positioning tool to position the workpiece, and the marking mechanism is configured to mark the workpiece. The driving mechanism can be further configured to move the positioning tool and the workpiece being marked to below the discharging mechanism, the driving assembly of the discharging mechanism can be configured to drive the coupling assembly of the discharging mechanism to carry the workpiece after being marked to the transmission member.

FIG. 1 illustrates an embodiment of a marking device 100 configured to mark a workpiece 200. The marking device 100 can include a support member 10, a transmission member 20, a feeding mechanism 30, a discharging mechanism 40, a driving mechanism 50, a positioning tool 60, and a marking mechanism 70. The support member 10 can support the transmission member 20, the feeding mechanism 30, and the discharging mechanism 40. The transmission member 20 can be mounted on the support member 10 and is configured to convey the workpiece 200. The feeding mechanism 30 can be mounted on the support member 10 and is configured to feed the workpiece 200 before marking. The discharging mechanism 40 can be mounted on the support member 10 and configured to discharge the workpiece 200 after being marked. The positioning tool 60 can be driven by the driving mechanism 50, to move in turn to the feeding mechanism 30, the discharging mechanism 40, and the marking mechanism 70. The positioning tool 60 can be configured to position the workpiece 200.

The support member 10 can be substantially a frame and include a first support portion 11, a second support portion 13, and a third support portion 15. The second support portion 13 and the third support portion 15 can be arranged on the first support portion 11 and located above the first support portion 11. The second support portion 13 and the third support portion 15 can be parallel to each other and substantially perpendicular to the first support portion 11. The first support portion 11 can be configured to support the transmission member 20. The second support portion 13 can be configured to support the feeding mechanism 30. The third support portion 15 can be configured to support the discharging mechanism 40. In at least one embodiment, the first support portion 11 can be a standing frame structure. The second support portion 13 and the third support portion 15 each can be substantially the shape of a stepped tower. The transmission member 20 can be a transmission belt coupled to the first support portion 11 for conveying the workpiece 200. The transmission member 20 can be horizontally positioned below the second support portion 13 and the third support portion 15.

The feeding mechanism 30 can include a driving assembly 31 and a coupling assembly 33. The driving assembly 31 can be mounted on the second support portion 13 and positioned above the transmission member 20. The coupling assembly 33 can be coupled to the driving assembly 31.

The driving assembly 31 can include a pair of fixing blocks 311, a guiding member 313, and a sliding member 315. The pair of fixing blocks 311 can be coupled to the second support portion 13. An imaginary line connecting the pair of fixing block 311 can be substantially vertical. A first end portion and a second end portion of the guiding member 313 can be respectively fixed to each of the pair of fixing blocks 311. The guiding member 313 can be vertically arranged and substantially perpendicular to the transmission member 20. In at least one embodiment, the guiding member 313 can include two parallel guiding rods. The sliding member 315 can be slidably sleeved on the guiding member 313 to slide along the guiding member 313. In at least one embodiment, the driving assembly 31 can be substantially in the shape of a cylinder.

The coupling assembly 33 can be coupled to the sliding member 315 and include a coupling member 331 and at least one coupling member 333. The coupling member 331 can be fixed to the sliding member 315. Thus, the coupling member 331 with the sliding member 315 can slide along the guiding member 313 to move towards or away from the transmission member 20. In at least one embodiment, the coupling assembly 33 can include four coupling members 333. The coupling members 333 can be mounted at a side of the coupling member 331 adjacent to the transmission member 20. Each coupling member 333 can be positioned at each of the four corners of the coupling member 331.

The discharging mechanism 40 has a structure similar to that of the feeding mechanism 30. The discharging mechanism 40 can include a driving assembly 41 and a coupling assembly 43. The driving assembly 41 can be mounted on the third support portion 15 and positioned above the transmission member 20. The coupling assembly 43 can be mounted on the driving assembly 41. The coupling assembly 43 can include a coupling member 431 and at least one coupling member 433. The coupling member 431 can be mounted on the driving assembly 41. The at least one coupling member 433 can be coupled to a side of the coupling member 431 adjacent to the transmission member 20. In at least one embodiment, the coupling assembly 43 can include four coupling members 433.

In at least one embodiment, the driving mechanism 50 can be a robot arm (partially shown in FIG. 1). The driving mechanism 50 can be positioned adjacent to the support member 10. An actuating end 51 of the driving mechanism 50 can be configured to move so that it can be positioned above the transmission member 20. The positioning tool 60 can be mounted on the actuating end 51 of the driving mechanism 50. Thus, the driving mechanism 50 can move the positioning tool 60 to be positioned above the feeding mechanism 30, or the marking mechanism 70, or the discharging mechanism 40.

Figure 2:
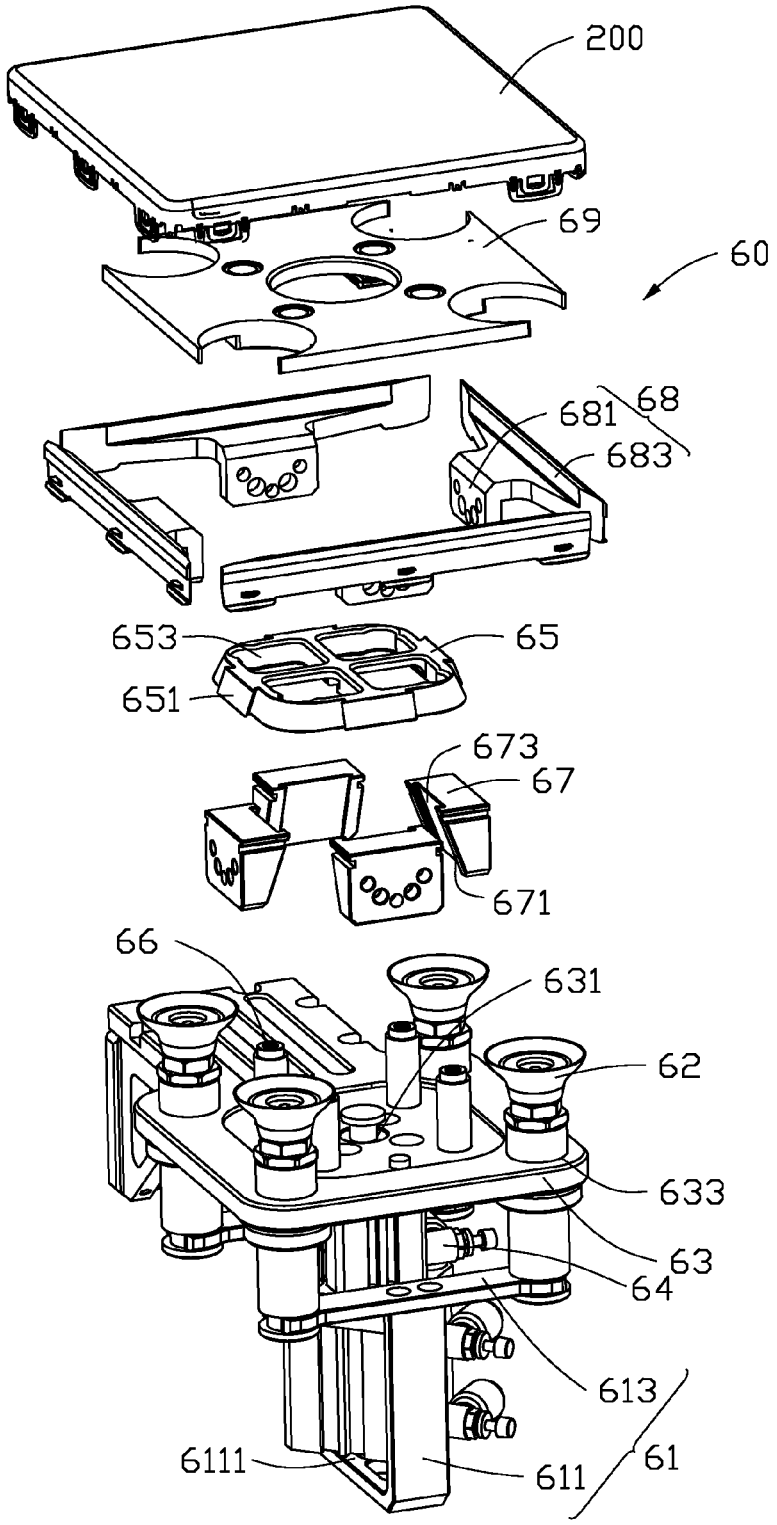
FIG. 2 is an exploded isometric view of the positioning tool of the marking device in FIG. 1.

FIG. 2 illustrates that the positioning tool 60 can include a bearing member 61, at least one sucking member 62, a mounting member 63, a driving member 64, a limiting member 65, at least one guiding member 66, at least one pair of engaging members 67 positioned on opposite sides of the limiting member 65, at least one pair of positioning members 68, and a mounting plate 69. The bearing member 61 can be configured to support the at least one sucking member 62 and the driving member 64. The bearing member 61 can include a first bearing portion 611 and a pair of second bearing portion 613. The first bearing portion 611 can resemble a three-sided square and define a receiving chamber 6111. The pair of second bearing portions 613 can be parallel to each other and respectively coupled to opposite ends of the first bearing portion 611. In at least one embodiment, the positioning tool 60 can include four sucking members 62. Two sucking members 62 can be perpendicularly positioned on a first end portion and another two sucking members 62 can be perpendicularly positioned on a second end portion of each second bearing portion 613.

The mounting member 63 can define an inserting hole 631 and four through holes 633. The inserting hole 631 can be defined at a substantially central portion and the through holes 633 can be arranged around the inserting hole 631. The sucking members 62 are mounted within the through holes 633. The mounting member 63 can be sleeved on the sucking members 62 via the through holes 633 and located above the bearing member 61. The mounting member 63 can be coupled to the actuating end 51 of the driving mechanism 50. In this way, the driving mechanism 50 can move the positioning tool 60.

The driving member 64 can be coupled to the bearing member 61. The driving member 64 can be received in the receiving chamber 6111 and partially pass through the inserting hole 631 of the mounting member 63. The driving member 64 can be configured to drive the limiting member 65 to move towards or away from the bearing member 61. In at least one embodiment, the driving member 64 can substantially be in the shape of a cylinder. The limiting member 65 can be movably positioned on the mounting member 63 and located at a side of the mounting member 63 away from the driving member 64. The limiting member 65 can be coupled to the driving member 64. The limiting member 65 resembles a cross within a square and the sidewalls of the limiting member 65 can be inclined towards a central axis of the limiting member 65 along a direction away from the driving member 64. An area of a top surface of the limiting member 65 can be smaller than that of the bottom surface of the limiting member 65. A limiting portion 651 can protrude from each sidewall of the limiting member 64. Each limiting portion 651 can be inclined inwardly along a direction away from the mounting member 63. The limiting member 65 can define at least one guiding hole 653. In at least one embodiment, the limiting member 65 can define four guiding holes 653 and the positioning tool 60 can include four guiding members 66 corresponding to the number of guiding holes 653. The guiding members 66 can be coupled to the mounting member 63 and inserted into the guiding holes 653 and configured to guide the limiting member 65 when driven by the driving member 64.

Figure 3:
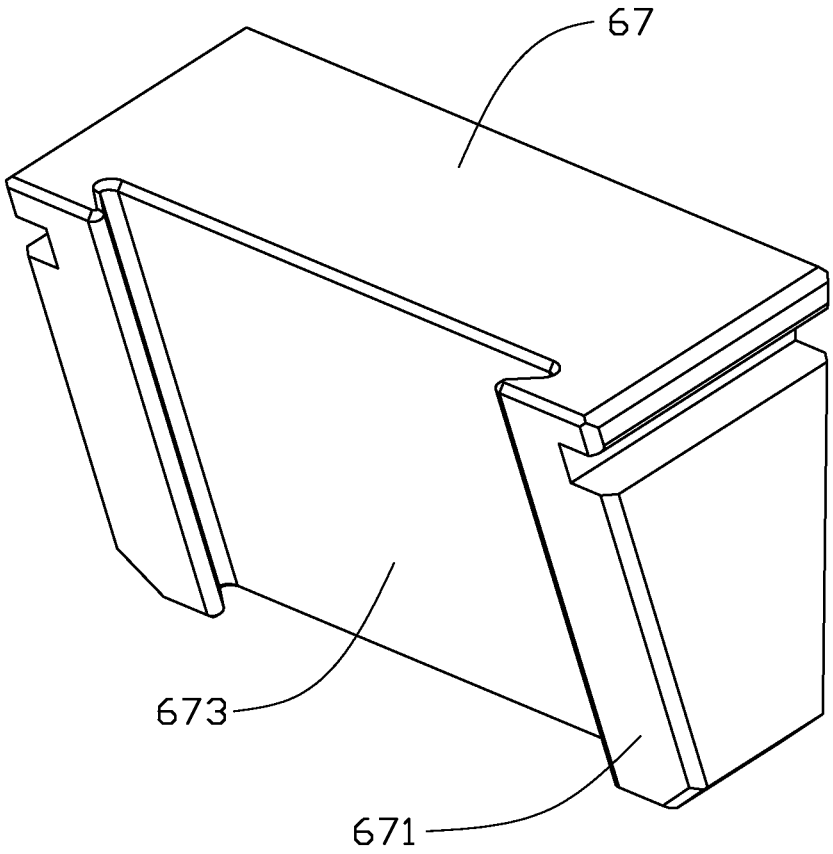
FIG. 3 is an isometric view of the engaging member of the positioning tool in FIG. 1.

In at least one embodiment, the limiting member 65 can include four limiting portions 651 and the positioning tool 60 can include two pairs of engaging members 67 and two pairs of positioning members 68, to matingly engage with the four limiting portions 651. The engaging member 67 can substantially be a block. The engaging members 67 can be positioned around the limiting member 65 and can engage with the limiting member 65. Each engaging member 67 can include an inclined surface 671 directing a limiting portion 651. An inclination direction of the inclined surface 671 can be same inclination as that of the limiting portion 651. Each inclined surface 671 can define an engaging groove 673 (also shown in FIG. 3). A bottom wall received in the engaging groove 673 can be parallel to the inclined surface 671. Each limiting portion 651 can be slidably received in the engaging groove 673 of an engaging member 67.

As illustrated in FIG. 2, the two pairs of positioning members 68 can be engaged with the two pairs of engaging members 67. Each positioning member 68 can be positioned at a side of an engaging member 67 away from the limiting member 65. Each positioning member 68 can include a fixing portion 681 and a positioning portion 683 formed on the fixing portion 681. The fixing portion 681 can be coupled to an engaging member 67. The positioning portion 683 can substantially be a bar and configured to position the workpiece 200. The positioning portions 683 of each pair of positioning members 68 can be positioned parallel to each other. The positioning portions 683 of the two pairs of positioning members 68 can define a rectangular frame. The fixing portions 681 of the two pairs of positioning members 68 can be received in the rectangular frame defined by the positioning portions 683. The mounting plate 69 can be sleeved on the sucking members 63 and supported on the engaging members 67 and positioning members 68. The marking mechanism can be positioned adjacent to the driving mechanism and configured to mark the workpiece 200 held by the positioning tool 60.

As illustrated in FIG. 1, in assembly, the support member 10 can be positioned adjacent to the driving mechanism 50 and the marking mechanism 70. The transmission member 20 can be mounted on the first support portion 11 of the support member 10. The feeding mechanism 30 and the discharging mechanism 40 can be respectively mounted on the second support portion 13 and the third support portion 15 of the support member 10. The mounting member 63 of the positioning tool 50 can be coupled to the actuating end 51 of the driving mechanism 50.

In use, the workpiece 200 can be carried by the transmission member 20. When the workpiece 200 is located below the feeding mechanism 30, the coupling members 333 of the feeding mechanism 30 lift up the workpiece 200 and the sliding member 315 drives the coupling assembly 33 and the workpiece 200 to move away from the transmission member 20 along the guiding member 313. The driving mechanism 50 drives the positioning tool 60 to move below the coupling assembly 33 and then the coupling assembly 33 releases the workpiece 200. Thus, the workpiece 200 is put onto the sucking members 62 of the positioning tool 60. The driving member 64 can drive the limiting member 65 to move towards the workpiece 200 along the guiding members 66. The limiting portions 651 of the limiting member 65 can slide along the engaging grooves 673. Because the limiting portion 651 can be inclined outwardly along a direction towards the driving member 64, the limiting portions 651 can direct the engaging members 67 to move away from the central axis of the limiting member 65. Thus, the positioning members 68 can move outwardly to hold the workpiece 200. After the workpiece 200 has been positioned, the driving mechanism 50 can drive the positioning tool 60 and the workpiece 200 to the marking mechanism 70 for marking. At the same time, a next workpiece can be carried to the feeding mechanism 30 via the transmission member 20, and the feeding mechanism 30 can select the next workpiece in preparation.

When marking the workpiece 200, the driving mechanism 50 can drive the positioning tool 60 to rotate the workpiece 200. The marking mechanism 70 can mark the workpiece 200 at different locations. After marking, the driving mechanism 50 can drive the positioning tool 60 and the workpiece 200 to be below the discharging mechanism 40. The driving member 64 of the positioning tool 60 can drive the limiting member 65 to move away from the workpiece 200 to release the workpiece 200. The sucking members 62 can stop vacuum-lifting the workpiece 200. The coupling member 433 can lift up the workpiece 200 after being marked. The driving assembly 41 can drive the coupling assembly 43 and the workpiece 200 towards the transmission member 20 to put the workpiece 200 on the transmission member 20. The driving mechanism 50 can move the positioning tool 60 to put the next workpiece in place.

In at least one embodiment, the positioning member 68 can be omitted and then the limiting member 65 can direct the engaging members 67 to directly position the workpiece 200. The engaging groove 673 of the engaging member 67 can be omitted and then the limiting portion 651 can directly direct the inclined surface 671.

The embodiments shown and described above are only examples. Many details are often found in the art such as the other features of a feeding device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A marking device comprising:

a support member;

a transmission member coupled to the support member and configured to convey a workpiece;

a feeding mechanism positioned on the support member, the feeding mechanism comprising a driving assembly coupled to the support member and an coupling member coupled to the driving assembly;

a discharging mechanism positioned on the support member and above the transmission member, the discharging mechanism comprising a driving assembly coupled to the support member and an coupling member coupled to the driving assembly of the discharging mechanism;

a driving mechanism positioned adjacent to the transmission member;

a positioning tool coupled to the driving mechanism;

a marking mechanism positioned adjacent to the transmission member, the driving assembly of the feeding mechanism being configured to drive the coupling assembly of the feeding mechanism to pick up the workpiece;

the driving mechanism being configured to move the positioning tool and the workpiece held by the positioning tool below the discharging mechanism;

the marking mechanism being configured to mark the workpiece;

the driving assembly of the discharging mechanism being configured to drive the coupling assembly of the discharging mechanism to lift up the workpiece being marked to the transmission member.

2. The marking device of claim 1, wherein the support member comprises:

a first support portion coupled to the transmission member, a second support portion coupled to the first support portion and extending in a direction away from the first support portion and further having the driving assembly of the feeding mechanism mounted thereon and being above the transmission member, and a third support portion coupled to the first support portion and extending in a direction away from the first support portion and further having the driving assembly of the discharging mechanism mounted thereon above the transmission member, the driving assembly of the discharging mechanism is mounted on the third support portion and positioned above the transmission member.

3. The marking device of claim 2, wherein the driving assembly of the feeding mechanism comprises:

a pair of fixing block coupled to the second support portion, a guiding member fixed to the pair of fixing block and perpendicular to the transmission member, and a sliding member slidably sleeved on the guiding member and being coupled to the coupling assembly of the feeding mechanism, wherein the slide member is configured to move the coupling assembly of the feeding mechanism along the guiding member.

4. The marking device of claim 3, wherein the coupling assembly of the feeding mechanism comprises a coupling member fixed to the sliding member and at least one coupling member coupled to the coupling member.

5. The marking device of claim 1, wherein the positioning tool comprises at least one sucking member and a mounting member sleeved on the sucking member and coupled to an actuating end of the driving mechanism.

6. The marking device of claim 5, wherein the positioning tool further comprises:

a bearing member coupled to the at least one sucking member and located below the mounting member, a driving member coupled to the bearing member and partially pass through the mounting member, a limiting member movably positioned on the mounting member and coupled to the driving member, and at least one pair of engaging members positioned opposite sides of the limiting member, wherein the driving member is configured to drive the limiting member and to direct the at least one pair of engaging member to move outward.

7. The marking device of claim 6, wherein at least two limiting portions protrude from sidewalls of the limiting member corresponding to the at least one pair of engaging member, so that each limiting portion is inclined inwardly along a direction away from the mounting member, and each engaging member comprises an inclined surface directing the corresponding limiting portion.

8. The marking device of claim 7, wherein each inclined surface defines an engaging groove, and each limiting portion is slidably received in the corresponding engaging groove.

9. The marking device of claim 6, wherein the positioning tool further comprises at least one pair of positioning member corresponding to the at least one pair of engaging member, wherein each positioning member comprises a fixing portion coupled to the corresponding engaging member and a positioning portion formed on the fixing portion.

10. The marking device of claim 6, wherein the positioning tool further comprises at least one guiding member, the limiting member defines at least one guiding holes, the at least one guiding member is coupled to the mounting member and inserted into the at least one guiding holes.

11. A marking device comprising:

a support member;

a transmission member coupled to the support member and configured to convey a workpiece;

a feeding mechanism positioned on the support member;

a discharging mechanism positioned on the support member and above the transmission member;

a driving mechanism positioned adjacent to the transmission member;

a positioning tool coupled to the driving mechanism;

a marking mechanism positioned adjacent to the transmission member, a driving assembly of the feeding mechanism being configured to drive the feeding mechanism to lift up the workpiece, the driving mechanism is configured to drive the positioning tool to position the workpiece; the marking mechanism being configured to mark the workpiece; the driving mechanism being further configured to move the positioning tool and the workpiece, such that the positioning tool and the workpiece being below the discharging mechanism, the discharging mechanism being configured to lift up the workpiece being marked to the transmission member.

12. The marking device of claim 11, wherein the support member comprises:

a first support portion coupled to the transmission member, a second support portion coupled to the transmission member and extending in a direction away from the first support portion and further having the driving assembly of the feeding mechanism mounted thereon and being above the transmission member, and a third support portion coupled to the first support portion and extending in a direction away from the first support portion and further having the driving assembly of the discharging mechanism mounted thereon above the transmission member, the discharging mechanism is mounted on the third support portion and positioned above the transmission member.

13. The marking device of claim 12, wherein:

the driving assembly is mounted on the second support portion and positioned above the transmission member, and a coupling member is coupled to the driving assembly of the feeding mechanism, the discharging mechanism comprises:

a driving assembly mounted on the third support portion and positioned above the transmission member, and a coupling member coupled to the driving assembly of the discharging mechanism.

14. The marking device of claim 13, wherein the driving assembly of the feeding mechanism comprises:

a pair of fixing block coupled to the second support portion, a guiding member fixed to the pair of fixing block and perpendicular to the transmission member, and a sliding member slidably sleeved on the guiding member and being coupled to the coupling assembly, wherein the slide member is configured to move the coupling assembly of the feeding mechanism along the guiding member.

15. The marking device of claim 14, wherein the coupling assembly of the feeding mechanism comprises a coupling member fixed to the sliding member and at least one coupling member coupled to the coupling member.

16. The marking device of claim 11, wherein the positioning tool comprises at least one sucking member and a mounting member sleeved on the sucking member and coupled to an actuating end of the driving mechanism.

17. The marking device of claim 16, wherein the positioning tool further comprises:

a bearing member coupled to the at least one sucking member and located below the mounting member, a driving member coupled to the bearing member and partially pass through the mounting member, a limiting member movably positioned on the mounting member and coupled to the driving member, and at least one pair of engaging members positioned opposite sides of the limiting member, wherein the driving member is configured to drive the limiting member, to direct the at least one pair of engaging member to move outward.

18. The marking device of claim 17, wherein at least two limiting portions protrude from sidewalls of the limiting member corresponding to the at least one pair of engaging member, so that each limiting portion is inclined inwardly along a direction away from the mounting member, and each engaging member comprises an inclined surface directing the corresponding limiting portion.

19. The marking device of claim 18, wherein each inclined surface defines an engaging groove, and each limiting portion is slidably received in the corresponding engaging groove.

20. The marking device of claim 17, wherein the positioning tool further comprises at least one pair of positioning member corresponding to the at least one pair of engaging member, wherein each positioning member comprises a fixing portion coupled to the corresponding engaging member and a positioning portion formed on the fixing portion, the positioning portion is substantially a rod.

* * * * *